United States Patent [19]

Birdwell

[11] Patent Number: 4,611,973

[45] Date of Patent: Sep. 16, 1986

[54] PUMPING SYSTEM AND METHOD OF OPERATING THE SAME

[75] Inventor: J. C. Birdwell, Houston, Tex.

[73] Assignee: P & B Industries, Houston, Tex.

[21] Appl. No.: 529,487

[22] Filed: Sep. 6, 1983

Related U.S. Application Data

[63] Continuation-in-part of Ser. No. 220,527, Dec. 29, 1980, abandoned, and a continuation-in-part of Ser. No. 309,979, Oct. 8, 1981, abandoned, and a continuation-in-part of Ser. No. 348,497, Feb. 11, 1983, abandoned, and a continuation-in-part of Ser. No. 455,509, Jan. 4, 1983, Pat. No. 4,541,779.

[51] Int. Cl.[4] ..... F04B 9/10

[52] U.S. Cl. ..... 417/342; 417/347; 417/401; 417/554

[58] Field of Search ..... 417/228, 342, 347, 392, 417/401, 403, 454, 471, 339, 346, 390; 277/3, 27, 71, 73, 74, 77, 103, 124; 91/530, 36

[56] References Cited

U.S. PATENT DOCUMENTS

| | | | |
|---|---|---|---|
| 677,137 | 6/1901 | Leavitt | 417/454 |
| 1,871,661 | 8/1932 | Carrier | 277/74 X |
| 2,186,968 | 1/1940 | Grau | 417/347 |
| 2,647,809 | 8/1953 | Schindler | 277/124 X |
| 2,805,090 | 9/1957 | Creek | 227/27 X |
| 2,807,215 | 9/1957 | Hawxhurst | 417/388 |
| 2,895,751 | 7/1959 | Standish | 277/3 |
| 2,998,781 | 9/1961 | Triebel | 417/342 X |
| 3,280,749 | 10/1966 | Sennet et al. | 417/342 |
| 3,295,451 | 1/1967 | Smith | 417/342 X |
| 3,373,695 | 3/1968 | Yohpe | 417/454 X |
| 3,455,501 | 7/1969 | Urben | 417/342 |
| 3,472,522 | 10/1969 | Winfrey | 277/74 X |
| 3,481,587 | 12/1969 | Ruhnau | 417/342 X |
| 3,514,226 | 5/1970 | Wood | 417/392 |
| 3,641,878 | 2/1972 | Rozwadowski | 417/401 X |
| 3,726,612 | 4/1973 | Greene, Jr. | 417/454 |
| 3,787,147 | 1/1974 | McClockin et al. | 417/401 X |
| 3,870,439 | 3/1975 | Stachowiak et al. | 417/454 |
| 4,350,080 | 9/1982 | Page, Jr. | 417/342 |

FOREIGN PATENT DOCUMENTS

| | | | |
|---|---|---|---|
| 133883 | 9/1929 | Fed. Rep. of Germany | 277/103 |
| 1291604 | 3/1961 | France | 417/228 |
| 19484 | of 1906 | United Kingdom | 417/392 |
| 1081867 | 9/1967 | United Kingdom | 277/73 |
| 576434 | 10/1977 | U.S.S.R. | 417/403 |

*Primary Examiner*—Leonard E. Smith

*Attorney, Agent, or Firm*—Arnold, White & Durkee

[57] ABSTRACT

Improved mud pump comprised of plural cylinder pumping units, each cylinder unit consisting of a pumping compression chamber and two or more hydraulic driven expansion chambers, with one or more expansion chambers being employed to drive a pumping plunger to cause fluid to be pumped through the compression chamber, also one or more of said expansion chambers being employed to return the plunger; the plunger further being employed as the housing for one or more of the said expansion chambers. The invention includes novel hydraulic drive circuitry and novel hydraulic distribution valving means for control of the hydraulic drive fluid that is utilized to drive the expansion chamber of each cylinder pumping unit. The invention also includes novel positioning means for the unidirectional inlet and outlet mud pumping valves.

16 Claims, 12 Drawing Figures

DRIVE CYL.11
CYL.1
TO CYL 2&3
51
231
52
142
87
141
117
116
CYL.3
CYL.2
CYL.2
CYL.3
93
123
118
122
VALVE
119
121
120
124
101
115
125
131
IN
VALVE
OUT
93
104
108
144
M
94
126
105
104
97
102
113
104
106
107
110
143
140
114
TO SEAL 58
139
128
104
109
91
M
92
96
M
112
111
129
95
100
104
138
135
134
104
99
98
133
90
130
229
131
132
104
103

136
88
M
89
137

Fig. 12
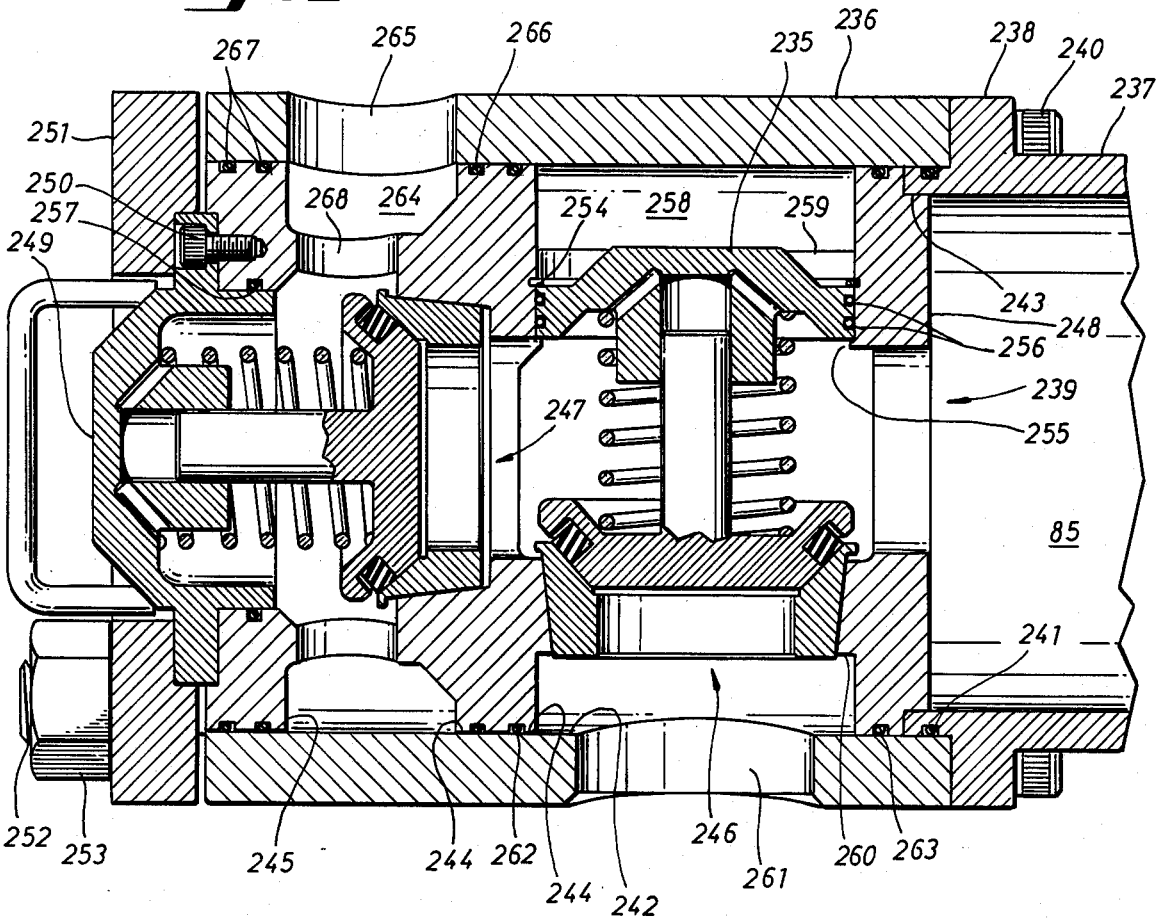
Fig. 8
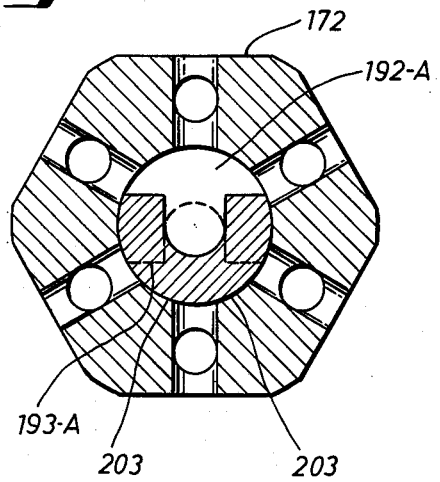
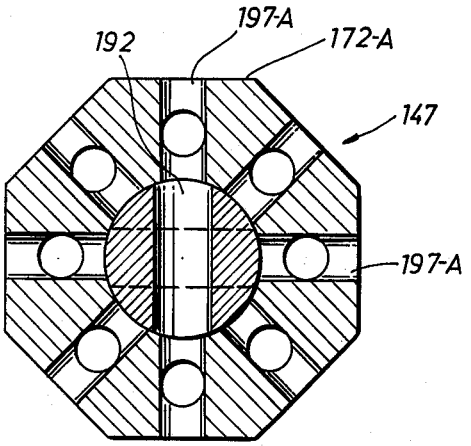
Fig. 9

PUMPING SYSTEM AND METHOD OF OPERATING THE SAME

REFERENCE TO OTHER APPLICATIONS

The present application is a continuation in part of copending application Ser. No. 220,527 filed Dec. 29, 1980, now abandoned; Ser. No. 309,979 filed Oct. 8, 1981, now abandoned; Ser. No. 348,497 filed Feb. 11, 1983, now abandoned; and Ser. No. 455,509 filed Jan. 4, 1983, now U.S. Pat. No. 4,541,779.

SUMMARY OF THE INVENTION

The improved mud pump of this invention has numerous and varied useful applications including the pumping of drilling mud used during the drilling and servicing of oil wells. Most mud pumps known in the art are mechanical driven piston or plunger type pumps that have limited capabilities pressure wise and flow wise when the pumps are pumping with a given piston or plunger size. The pump according to the present invention is a hydraulic driven pump employed primairly as a plunger type pump having the capability of an extended range of flow and pressure output capacity with variable volume and non pulsating output characteristics.

The pump of the present invention is likewise subject to smaller size, less weight, better adaptability, improved performance, and easier maintenance than conventional pumps, thus making it suitable for numerous and varied applications.

BRIEF DESCRIPTIONS OF THE DRAWINGS

FIG. 8 is a section view taken along the lines 7—7 of FIG. 6 showing a modified distribution spool from that shown in FIG. 6.

FIG. 9 is a section view taken along the lines 7—7 of FIG. 6 showing a modified valve housing from that shown in FIG. 6. Also FIG. 9 represents the distribution valve employed in the system of FIG. 4.

FIG. 12 is a section view of a preferred alternate means of attaching the unidirectional inlet and outlet flow valves to the mud pumping cylinders of this invention.

DETAILED DESCRIPTION OF THE PREFERRED EMBODIMENT

Figure 1:
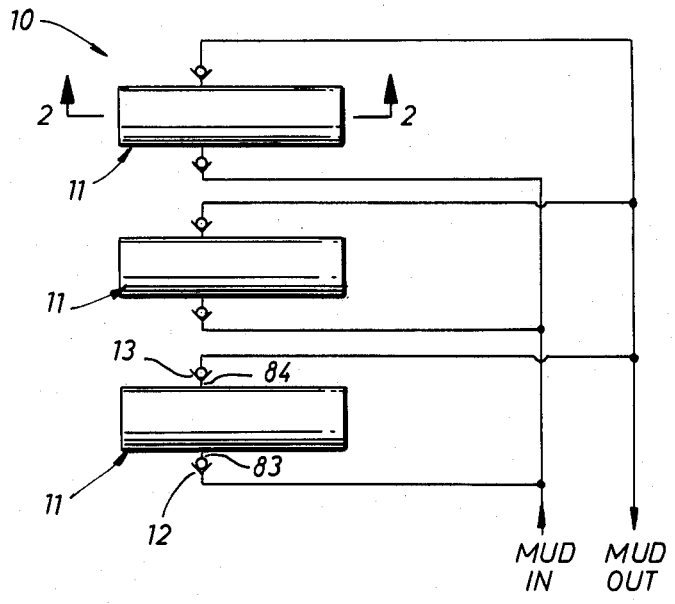
FIG. 1 is a schematic plan view of a multicylinder mud pump in accordance with the teachings of the present invention. The hydraulic driving fluid supply and distribution system is not shown in this plan view.

Attention is first directed to FIG. 1 of the drawings where the numeral 10 generally indentifies the mud pump of the present invention. In this illustrated embodiment a plan view of a mud pump employing three pumping cylinders is shown. Three or more pumping cylinders is the preferred arrangement for this pump. Each pumping cylinder 11 is the same in cross section and is connected to a common mud inlet manifold and to a common mud outlet manifold. Unidirectional inlet flow valves 12 lead to each pumping cylinder and unidirectional outlet valves 13 lead from each pumping cylinder so that the pumped fluid is drawn into each pumping cylinder from a common inlet fluid line and discharged from each pumping cylinder to a common discharge line.

Figure 2:
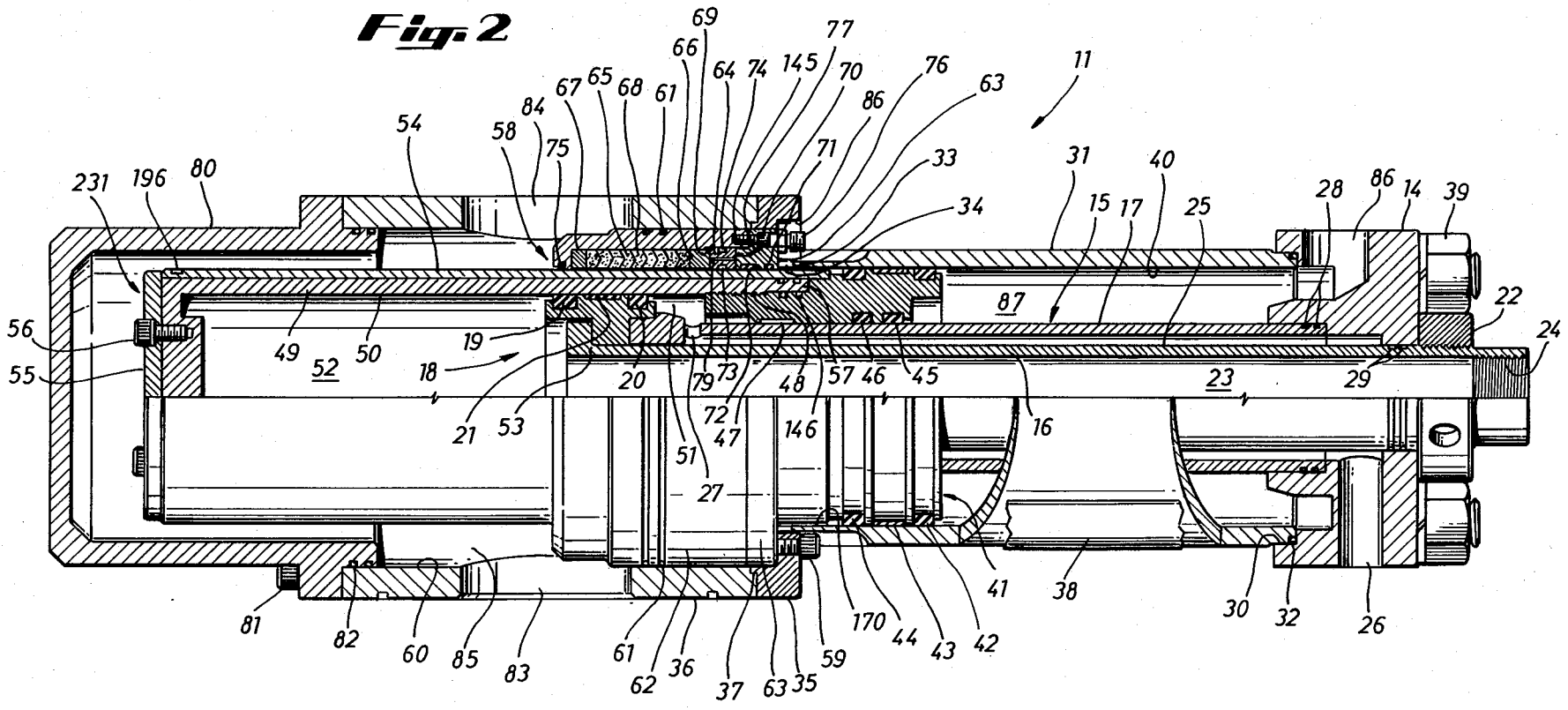
FIG. 2 is a section view taken along the line 2—2 FIG. 1.

Attention is next directed to FIG. 2 which is a section view of a typical pumping cylinder 11 that is taken along the lines 2—2 of FIG. 1. Cylinder 11 has an end flange 14 that rigidly supports a central tubular assembly 15. Assembly 15 is comprised of an inner tube member 16 and an outer tube member 17. Tube member 16 carries upon its end a piston assembly 18 which has seals 19 and 20 and a wear ring 21. Assembly 15 is constructed so that piston assembly 18 is retained in place by member 17 which is compressed by the end flange 14, with member 16 extending through end flange 14 and being secured by a nut 22. Member 16 has a central bore 23 therethrough with threads 24 on its outer end for a fluid connection. Member 17 has a finely finished outer surface that is formed concentric to the centerline of member 16. A bore 25 is formed between the outer circumference of member 16 and the inner circumference of member 17. On one end, bore 25 connects to a fluid inlet port 26 that is formed in end flange 14, and on the other end bore 25 exits through member 17 at an opening 27. Bore 25 is sealed on the one end by seals 28 and 29. Port 26 is fitted on its outer end for a fluid connection.

End flange 14 is fitted on its inner side with a circular recess 30 into which is mounted a piston housing 31, with housing 31 being sealed on its end by seal 32. Housing 31 extends inward from flange 14 and has a pilot 33 which fits into a circular recess 34 of a retainer flange 35. Flange 35 is in turn aligned to a head flange member 36 by a circular pilot member 37. Member 35 is attached to head flange 36 by rods 38 which are threaded into member 36 and have a shoulder (not shown) that presses member 35 against member 36. Bolts 38 extend outward from member 35 and pass through end flange 14 and are secured by nuts 39. Thus nuts 39 securely retain in place central tubular assembly 15, end flange 14, piston housing 31, head flange 36, and flange 35; with the piston bore 40 of housing 31 being positioned to align concentric to the outer circumference of member 15 and concentric to piston assembly 18.

Piston housing 31 carries within its bore 40 a piston assembly 41 with fluid seal 42, wear ring 43, and wiper seal 44 positioned on its outer circumference. Piston assembly 41 has a central bore therethrough into which is fitted seals 45, 46, and wear ring 47 that are all positioned to allow piston 41 to sealingly traverse upon the outer circumference of member 15. On its one end, piston 41 has a thread 48 onto which is attached a second piston housing 49. Housing 49 has a central bore 50 extending partially therethrough which is finely finished to receive piston assembly 18 of assembly 15, thus forming an expansion chamber 51 on a one side and expansion chamber 52 on the other side. Expansion chamber 52 connects with bore 23, and expansion chamber 51 connects with fluid inlet 26 through bore 25 and opening 27. A seal 53 is positioned between chambers 51 and 52.

The outer end of bore 40 of piston housing 31 has an annual connection to a fluid inlet port 86 that is formed in head flange 14. Thus piston 41 and bore 40 forms the fluid expansion chamber 87. Inlet port 86 is fitted on its outer end to receive a fluid connection.

Piston housing 49 contains a replaceable liner 54 that fits snugly upon the outer circumference of housing 49 and that is held firmly in place by end cap 55 and bolts 56. Liner 54 has a round, smooth, and hardened outer circumference that is positioned to be concentric to the outer circumference of assembly 41 and piston assembly 18. Seals 57 fitted upon the outer diameter of piston housing 49 form a circumferential seal between housing 49 and linear 54. Seal 146 fitted upon the outer diameter of piston assembly 41 form a circumferential seal between piston housing 49 and piston assembly 41. Thus liner 54 defines the outer circumference of a pumping plunger 231.

Sealingly and slidably fitted upon the outer circumference of liner 54 is a plunger seal assembly 58. Assembly 58 is slidably and sealingly positioned within a bore 60 of head flange 36 and ridigly held in place by bolts 59 which extend through flange 35 and into assembly 58. Seals 61 form a circumferential seal between the outer circumference of assembly 58 and bore 60. Bore 60 is a circular bore therethrough head flange 36 and is positioned concentric to the outer circumference of linear 54.

Plunger seal assembly 58 is the same as the rod seal assembly disclosed in my patent application Ser. No. 309,979, and reference is made to this application for more detailed description of the operation of this assembly. Briefly, assembly 58 consists of an outer housing 62, an end plate 63, a slidable piston 64 and a seal element 65 with the seal element consisting of pliable seal members 68 with end rings 66 and 67 positioned on each end thereof. Members 64 and 65 are pressed together and contained in a circular bore 69 of housing 62 by end plate 63 which is mounted to housing 62 by bolts 70. End plate 63 contains a slidable seal at 71 and 72 and a stationary seal at 145. Piston 64 contains slidable seals at 73 and 74, and housing 62 contains slidable seals at 61 and a slidable wiper seal at 75. End plate 63 further contains a hose connection at 76 which forms a sealed annular connection to seal elements 65 through hole 77 and orifice 79. Thus when pressurized fluid is applied at hose connection 76, then the fluid will travel through hole 77 and orifice 79, thusly lubricating seal assembly 65.

Leading outward from head flange 36 is an end cap 80 which is sealingly connected to flange 36 by bolts 81 and seals 82. Head flange 36 contains openings 83 and 84 which are normally fitted with sealed annular connection means to a unidirectional inlet flow valve on the one side, and to a unidirectional outlet flow valve on the other side. With these unidirectional flow valves attached, then an expansion chamber 85 is formed whereby as piston assembly 41 is reciprocally driven, then chamber 85 will expand and contract thus pumping fluid therethrough chamber 85 if the inlet valve is connected to a fluid supply. Hydraulic driving fluid is connected to expansion chambers 51, 52, and 87 in such a manner, as will be discussed later, so that piston 41 will be caused to powerly reciprocate.

It will be noted that the arrangement of the different expansion chambers as disclosed above will completely isolate the hydraulic driving fluid from the fluid that is being pumped. Any hydraulic fluid that leaks externally across piston 41, or any mud (pumped fluid) that leaks past seal 65 will be exhausted through the opening 86. It will additionally be noted that if another hydraulic drive expansion chamber were desired for any reason then it could be added by placing a shoulder at 170 that contains seals that are slidable against linear 54.

Figure 3:
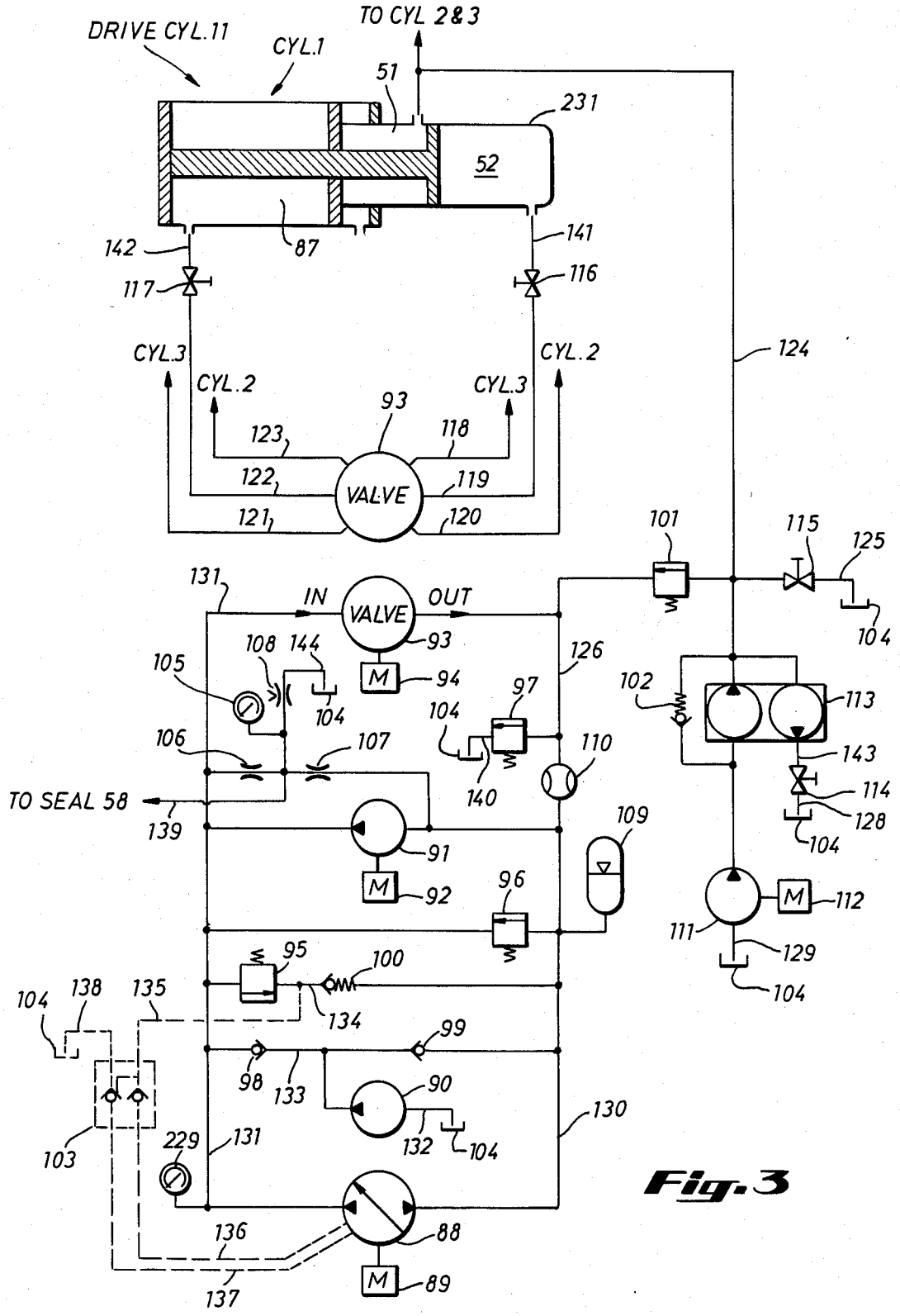
FIG. 3 is a schematic drawing showing a first typical hydraulic power and distribution system employed to drive a mud pump of the present invention.

Attention is next directed to FIG. 3, which is a schematic drawing of a preferred hydraulic drive circuit for the cylinder 11 drive means of this pump. Hydraulic drive cylinder 11 is illustrated in schematic form for clarity, with only one drive cylinder 11 being illustrated. In FIG. 3, a variable volume hydraulic pump 88 is driven by a motor 89. Pump 88 is an over center type pump that can pump in either direction. Motor 89 also drives an auxillary pump 90 that is employed as a circuit charge pump. The remainder of the circuit consists of a hydraulic pump 91 that is driven by a motor 92, a fluid distribution valve 93 that is driven by motor 94, high pressure relief valve 94, low pressure relief valves 96 and 97, check valves 98 and 99, spring loaded check valves 100 and 102, double lock valve 103, hydraulic reservoir 104, pressure gage 105, flow orifice 106 and 107, variable orifice 108, accumulator 109, fluid flowmeter 110, auxiliary pump 111 that is driven by motor 112, combined pump and motor unit 113, shut off valves 114, 115, 116, and 117, hydraulic lines 118 through 144, and relief valve 101.

The hydraulic circuit of FIG. 3 is primarily a charged, closed loop circuit employing a variable volume pump 88 and a constant volume pump 91 in a unique arrangement whereby the two pumps are arranged to provide the equivalent output of a single variable volume pump. The advantage of this arrangement being that the constant volume pump 91 is less expensive, much lighter, and does not require control means.

In operation, (it's preferred that pump 88 and pump 91 have the same flow output) the variable pump 88 is moved over-center to absorb the flow from pump 91 when zero flow input to valve 93 is desired. Thus as pump 88 is adjusted from full reverse to full forward, then the flow in line 131 to valve 93 goes from zero to the full capacity of pump 88 plus pump 91. The overall operation of the drive system of FIG. 3 will be more fully explained later.

Figure 4:
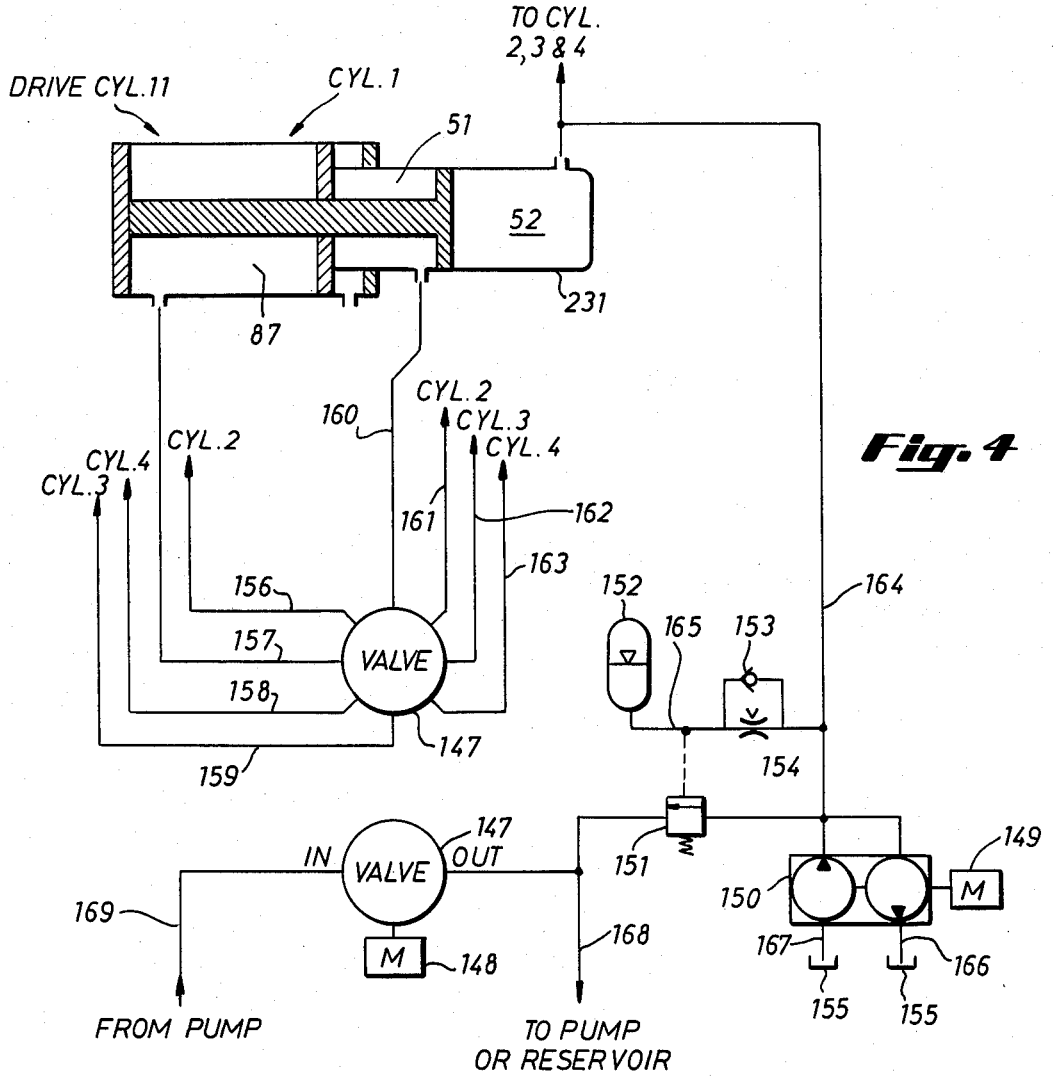
FIG. 4 is a schematic drawing showing a second typical hydraulic power and distribution system employed to drive a second mud pump of the present invention.

Attention is next directed to FIG. 4, which is a modified variation of the drive system of FIG. 3. In this schematic drawing the main hydraulic supply pump is not shown. The hydraulic driving fluid could be supplied from various types of sources. In the circuit of FIG. 4 an eight outlet distribution valve is normally employed to operate four separate drive cylinders. The circuit of FIG. 4 consists of a distribution valve 147 that is driven by a motor 148, a motor 149 driving a combination hydraulic pump and motor unit 150, a relief valve 151 that is controlled by an accumulator 152 and check valve 153 and variable flow valve 154, hydarulic reservoir 155, and hydraulic flow lines 156 through 169.

The operation of the circuit of FIG. 4 will be explained later.

Figure 5:
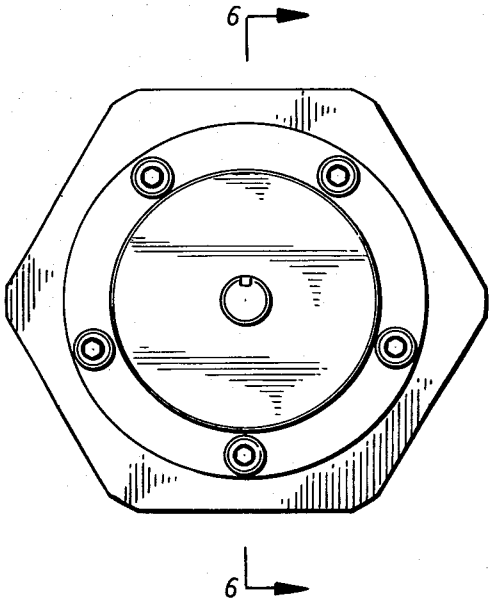
FIG. 5 is an end view of the driving fluid distribution valve employed in the system of FIG. 3.
Figure 6:
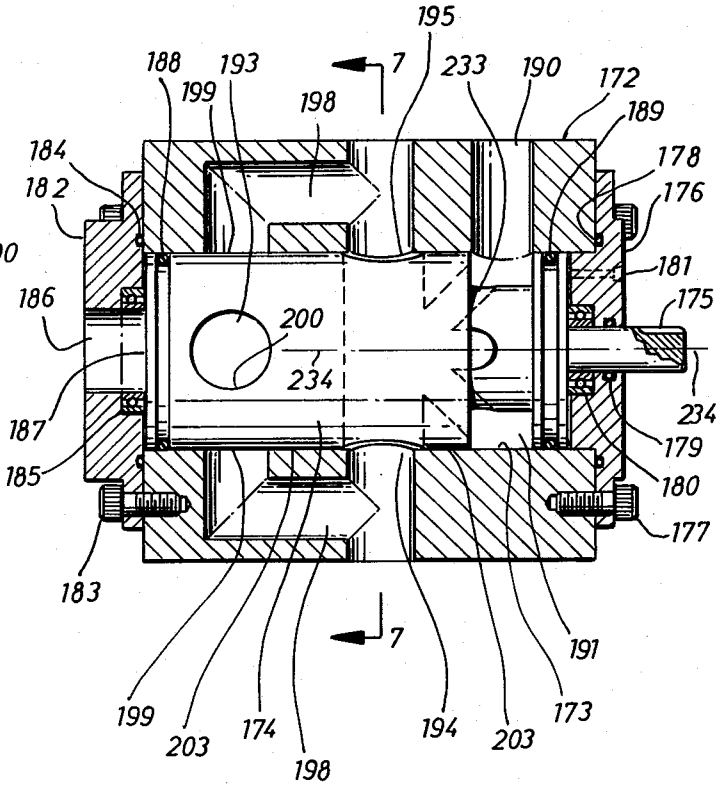
FIG. 6 is a section view taken along the lines 6—6 of FIG. 5.
Figure 7:
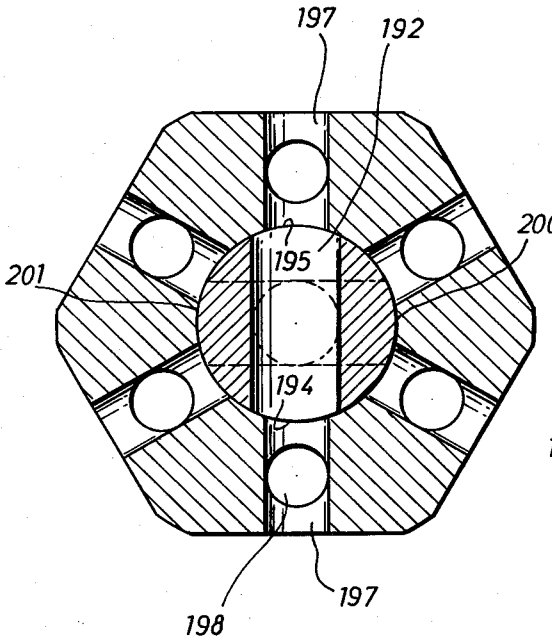
FIG. 7 is a section view taken along the lines 7—7 of FIG. 6.

Attention is next directed to FIG. 5, FIG. 6, and FIG. 7, where the distribution valve 93 of FIG. 3 is shown. Valve 93 consists of a housing 172 with a central bore 173 therethrough. Mounted within bore 173 is a rotary spool member 174 with a drive shaft 175 extending through an end plate 176 that is rigidly connected to housing 172 by bolts 177. End plate 176 is fitted with a seal 178 and a shaft seal 179. End plate 176 also retains a thrust bearing 180 that is positioned to form a gap between spool 174 and plate 176. A small port 181 passes through plate 176 and makes annular communication with this gap, with the port being fitted on its outer end with means for a hose connection to allow supply and drainage of fluid to and from the gap and bearing.

Housing 172 contains on its other end a second end plate 182 that is firmly attached by bolts 183. Plate 182 contains a seal 184 and is fitted with a thrust bearing 185 that presses lightly against a second end of spool 174 and end plate 182. A fluid outlet port 186 passes centrally through end flange 182 and makes communication with an end port 187 that leads centrally from spool 174. Spool 174 has a circumferential seal 188 on one end and 189 on the other end.

Housing 172 contains one or more fluid inlet ports 190 passing through a side and into bore 173. In line with port 190, a groove 191 is formed in the outer circumference of spool 174. Spool 174 additionally contains a port 192 and a port 193 therethrough. The centerline of port 192 and port 193 are perpendicular to, and pass through a centerline 234 of spool 174. Port 192 contains directly opposed and equally formed openings 194 and 195 leading from spool 174. Port 193 contains directly opposed and equally formed openings 200 and 201 leading from spool 174. Openings 194, 195, 200, and 201, are at exacting 90 degree spacing around the circumferences of spool 174. Spool 174 also contains internal fluid passages 233 that connects groove 191 to port 192. Likewise port 193 connects with end port 187. Housing 172 also contains 6 ports 197 that are evenly spaced around the circumference of bore 173 and that lead through the sides of housing 172 and into bore 173. The centerline of ports 197 are positioned to be perpendictular to, and to intersect, the centerline of bore 173 (and spool 174). Ports 197 are further positioned to be in the same plane as ports 192 of sppol 174 and are sized so that alternately two ports 197 then four ports 197 are in communication with port 192, with at least two ports 197 always being in communication with port 192 as spool 174 rotates.

Housing 172 further contains 6 passageways 198 with each passageway connecting with a one port 197. Each passageway 198 also leads to an outlet 199 that opens into bore 173 in the same plane as port 193 of spool 174. Outlets 199 are in the same plane as ports 197 and are evenly spaced around the circumference of bore 173 in a like manner as described for ports 197. Outlets 199 are sized so that (as spool 174 rotates) alternately 2 outlets 199, then 4 outlets 199 are in communication with port 193 of spool 174 with at least two ports 199 always being in communication with port 193. Also ports 197 and outlets 199 are sized so that, as spool 174 rotates, ports 197 will never be in communication with spool port 192 at the same time that its interconnecting passageways 198 outlet 199 is in communication with spool port 193.

Thus it can be seen that as power is applied to shaft 175 to rotate spool 174, and pressurized fluid is connected to inlet port 190; then pressurized fluid will be successively supplied to each port 197 through spool port 192, and likewise sucessively exhausted from port 197 through spool port 193 and outlet 186.

Spool 174 and bore 173 are finely finished so that spool 174 is sealingly rotatable within bore 173. It will be noted that any number of housing ports 197 and outlets 199 may be employed as well as any number of spool ports 192 and 193; however, to maintain the preferred operating characteristics, fluid communication cannot exist between spool ports 192 and 193.

It is noted that the valve of FIG. 5, FIG. 6, and FIG. 7, is the same at that disclosed in my pending application Ser. No. 455,509, and reference is made to this application for further information.

Attention is next directed to FIG. 8 which shows the same section 7—7 of FIG. 6 with ports 192 and 193 having been altered somewhat. In FIG. 8 port 192 is now shown a port 192-A and is now ported to one side only of spool 174; Likewise port 193 is shown as 193-A (shown in dashed lines) and is now ported to a second side only of spool 174, with the one side and the second side being directly opposed. It is additionally noted that since this type porting will create pressure unbalance upon spool 174, then this unbalance must be corrected for, which can be done by providing one or more recesses at given points in the circumference of spool 174 with these recesses being connected to the pressure within port 192-A (or 193-A) and being sized and positioned to oppose (upon spool 174) the forces created by port 192-A. The surfaces designated by 203 (FIG. 6) show areas where these recesses can be created upon spool 174. Likewise exhaust port 193-A can be so counterbalanced by recesses in spool 174.

The significance of employing the spool of FIG. 8 instead of the spool of FIG. 6 being that the two spools will give different operating characteristics. The spool of FIG. 8 can be employed to pressurize (drive) more cylinders at the same time and will give one pressure cycle per spool revolution, whereas the spool of FIG. 6 will give two pressure cycles per revolution. Likewise, the employment of these different spools would normally require different connections to pressure chambers of drive cylinder 11. The spool of FIG. 8 may normally be employed to drive, for example, six separate cylinders 11, instead of three.

Attention is next directed fo FIG. 9 which shows a section of the valve 147 that is employed in the circuit of FIG. 4. Valve 147 is the same as valve 93 except valve 147 employes eight housing ports 197 that are noted as 197-A. Ports 197-A are evenly spaced around the circumference of a bore 173-A in a similar manner as described for valve 93.

Figure 10:
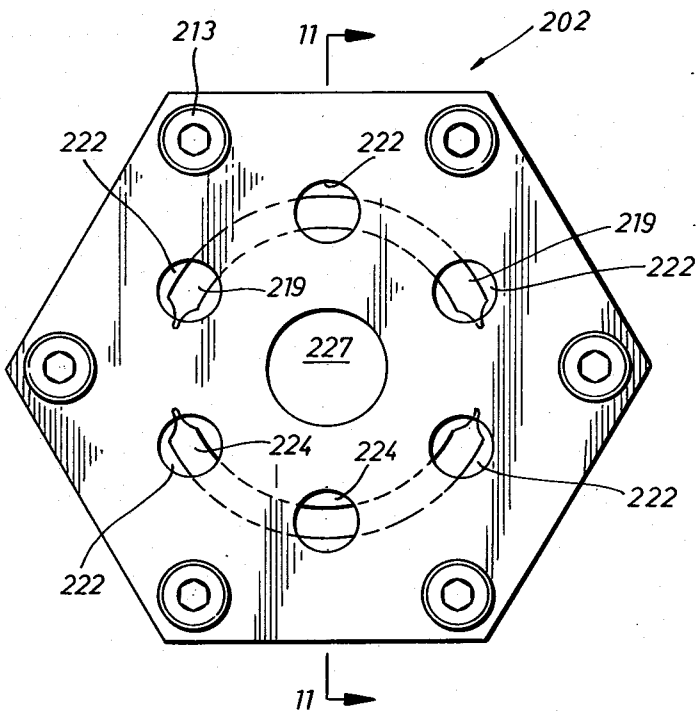
FIG. 10 is an end view of an alternate typical fluid distribution valve that can be employed in the driving fluid system of the mud pump of the present invention.
Figure 11:
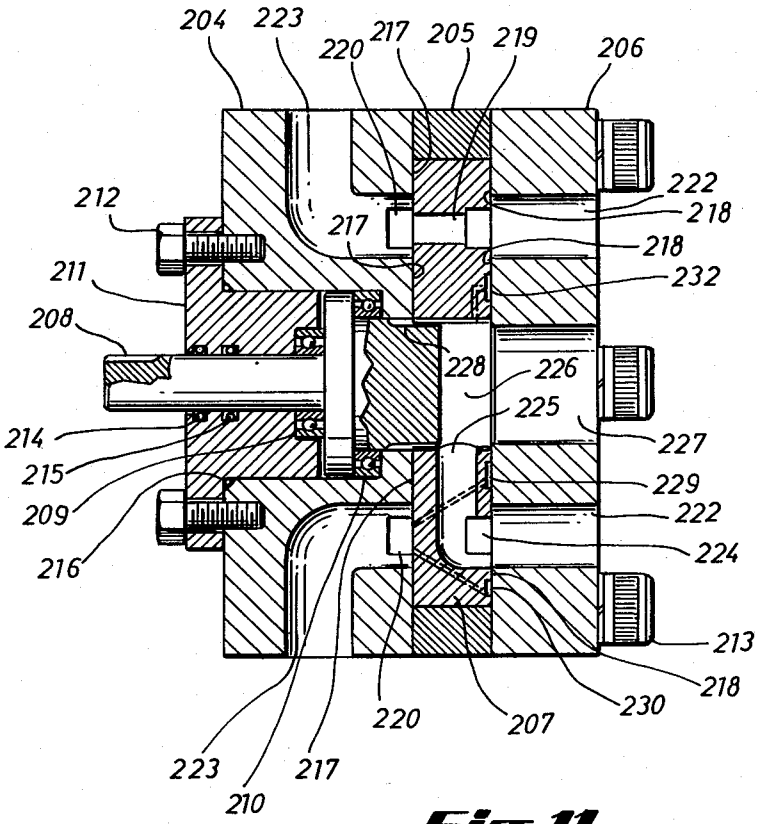
FIG. 11 is a section view taken along the lines 11—11 of FIG. 10.

Attention is next directed to FIG. 10 and FIG. 11 which shows an alternate type of distribution valve 202 that can be employed in the place of typical valve 93 to drive a multi-cylinder pumping system of the type disclosed in this invention. FIG. 11 is a section view 11—11 of FIG. 10. The valve 202 consists of a fluid inlet section 204, a valve plate spacer 205, a fluid outlet section 206, a valve plate 207, a drive shaft 208 that is retained in place by bearings 209 and 210 which are in turn positioned by an end cap 211 that is connected to section 204 by bolts 212 and bolts 213 which pass through section 206 and 205 and threadingly connect to section 204. Shaft seals 214 and 215 and seal 216 guard against external fluid leakage.

Valve plate 207 is finely finished to rotatably and sealingly slide against correspondingly finely finished surfaces of section 204 and 206 at 217 and 218. Spacer member 205 is likewise finished to seal against pressure at surfaces 217 and 218 and is finished to be of slightly greater width than valve plate 207 so that plate 207 can sealingly rotate. Valve plate 207 contains a segmented circular port 219 passing therethrough that makes continual annular communication with a circular groove 220 that is formed in the end of section 204. Port 219 likewise makes annular communication with one or more fluid pressure ports 222 that pass through section 206 and that are fitted at their outlet to receive fluid pressure lines. Ports 222 normally consists of three or more ports and are evenly spaced within a circle about the centerline of drive shaft 208. Groove 220 makes annual communication with pressure inlet ports 223 which are fitted to receive a pressurized fluid supply.

Valve plate 207 contains a second segmented circular port 224 that is recessed into plate 207. Port 224 is similar to port 219 and formed to make communication with one or more ports 222 in a like manner as described for ports 219. Leading from port 224 is a second port 225 that leads into a central bore 226 of plate 207. Bore 226 connects on a one end to a fluid exhaust port 227, and on the other end bore 226 is fitted with splines at 228 which drivingly mate with like splines that are formed on the end of drive shaft 208. Port 227 is fitted on its outer end to receive a fluid pressure line.

Thus as pressurized fluid is supplied to ports 223 and drive shaft 208 is rotated then pressureized fluid can be caused to flow continually to one or more ports 222 for distribution to a drive cylinder 11, while correspondingly exhaust flow can continually be returned from one or more ports 222 to be exhausted through return port 227.

Valve plate 227 is typically equipped with semi circular recessed grooves at 229, 230, and 232, with these grooves being ported to pressurized fluid as required to equalize the forces exerted upon plate 207 by the different pressurized fluid ports, so that plate 207 can rotate freely without pressurized side loading.

The significance of valve 202 is that it can possibly give an improved means of fluid distribution to drive the cylinders 11 of this invention, in particular note that the distribution spool 207 of valve 202 provides adequate spacing for the inlet and exhaust tapering of distribution ports 219 and 224, which provide means for smoother operating characteristics. It is further noted that valve 202 when applied to the different drive circuits of this invention will give operating characteristics that are equivalent to the operating characteristics of the valve illustrated by FIG. 8. It is further noted that two ports 219 that are located at 180 degree spacing could be employed in combination with two ports 224 that are located at 180 degree spacing; This arrangement would, when valve 202 is applied to the different drive circuits of this invention, give operating characteristics that are equivalent to the operating characteristics of the valve illustrated by FIG. 5, FIG. 6 and FIG. 7. Valve 202 is not limited to a specific number of pressure distribution ports 219 and 224, or a specific number of cylinder ports 222.

Attention is next directed to FIG. 12 which shows a section view of an alternated means of attaching the pumped (mud) fluid inlet and outlet valves to cylinders 11. In FIG. 12 a valve housing 236 is shown that attaches to head flanges 36 by an adaptor tube 237. Tube 237 replaces end cap 80 and attaches to flange 36 the same way (not shown) as does end cap 80. Tube 237 contains on its outer end a flange 238 which sealingly attaches to housing 236 by bolts 240 and seal 241. Housing 236 contains a central bore 242 therethrough which is aligned concentric to the centerline of reciprocation of piston housing 49 by a boss 243 on the end of tube 237. Bore 242 has a slightly reduced diameter at 244 and at 245, with the surface at 245 being of the larger diameter.

Contained within bore 242 of housing 236 is valve assembly 239 which consists of an inlet valve 246 and an outlet valve 247 contained within a removable cartridge 248, and an outlet valve cap 249 that is connected to item 248 by bolts 250. Cartridge 248 is formed to be slidably and sealingly inserted into bore 242 and to be retained in place by an end plate 251 that is attached to housing 236 by studs 252 and nuts 253. End plate 251 presses against valve cap 249 to press member 248 against boss 243. Inlet valve 246 is retained in place by a cap 235 and snap ring 254, with member 235 being retained from moving inward by a shoulder at 255. Seals 256 guard against fluid leadkage past member 235 and seal 257 guard against fluid leakage past member 249. A circumferential groove 258 is formed in member 248 with flats at 259 and 260. Groove 258 forms a sealed annular communication with a fluid inlet port 261 that passes through a side of housing 236. Groove 256 is sealed by seals 262 and 263.

A second circumferential groove 264 is formed in member 248 which communicates with an outlet pressure port 265 that is formed through the side of housing 236. Groove 264 is sealed by seals 266 and 267 and has annular communication with outlet valve 247 through openings 268. Thus as piston housing 49 is reciprocated (with ports 83 and 84 capped), then expansion chamber 85 will expand and contract and thus can cause fluid to be drawn in across inlet valve 246 and then exhausted under pressure through exhaust valve 247 and pressure port 265. Valve housing 239 is normally a square like oblong member.

A brief discussion of the operation of the pumping system of this invention as disclosed by the circuit of FIG. 3 is presented in the following paragraphs.

The drive fluid supply pumping cirucitry of FIG. 3 is that of a pressurized closed loop system that will be apparent, except for specialty deviations, to anyone versed in the art. Thus pressurized fluid is supplied to valve 93 (shown in two parts) from pumps 88 and 91; From there it is distributed to cylinders 1, 2 and 3 (Cyl. 11) of the pumping system in a sequental and overlapping manner, and returned from cylinders 1, 2 and 3 in a sequental and overlapping manner, to cause the plungers 231 of cylinders 1, 2 and 3 to be reciprocally driven; With one or more plungers being powerly extended by the pressurized pumping fluid, while at the same time one or more plungers are being retracted by the fluid that is trapped in chambers 51. Chambers 51 of all drive cylinders are interconnected for fluid flow therebetween, so that fluid driven from a one chamber 51 will expand a second chamber 51 to retract the plunger. Thus as plungers 231 are reciprocally driven (Refer to FIGS. 1 and 2) then fluid will be drawn through inlet valve 12 into chamber 85 and then discharged under pressure through outlet valve 13. The overall output of the pumped (mud) fluid will be in a continuous and non pulsating manner as the pumped flow rate and pressure will be in a duplicate form to that of the pumping fluid flow, with the pumped flow rate and pressure being determined by the ratio of the drive piston size as compared to the pumping piston size.

Observing FIG. 3 it is noted that a shut off valve 116 and 117 is contained on each pressure line leading from valve 93 to cylinder 11. It will further be noted that by selectively opening or closing these valves, then cylinders 11 can be operable with drive chambers 87 being the only drive chambers employed, with drive chambers 52 being the only drive chambers being employed, or with drive chamber 87 plus drive chambers 52 being employed. It is pointed out that any expansion chamber not being utalized must be vented or open to fluid. Thus the pump of this invention provides a wide range of flow and pressure output capabilities without having to change liner or plunger sizes. Also, the problems associated with drive shaft deflections are effectively eliminated.

Fluid flowmeter 110 that is on the return fluid line of the hydraulic circuit records the drive fluid flow that is passed through drive cylinders 11, this in turn (multiplied by a factor) accurately indicates the pumped fluid flow. Gage 229 that is on the drive pressure flow line records the drive fluid pressure which in turn (multiplied by a factor) accurately indicates the pumped fluid pressure. Thus means are provided for local or remote read out or recording of the main operating characteristics of the pumped fluid. These features are sometimes extremly difficult to accomplish on conventional type pumps because o the corrosive and abrasive nature of the fluid being pumped.

The circuitery illustrated by relief valve 95, check valve 100, and lock valves 103, demonstrates a technique that can be employed to automatically and efficiently control the output pumped pressure to selected magnitude. This is accomplished by automatically de-stroking the hydraulic pump to cause the pump to supply the flow rate that will give the selected pressure. There are many other methods of de-stroking the pump—The one I selected for illustration is only typical and it will be understood that my invention is not limited to this illustrated technique. Relief valve 95 can be adjusted to bypass fluid at any desired pressure. When the flow passes across relief valve 95 it will further pass through check valve 100 which normally has a spring loaded of around 50 P.S.I. This 50 P.S.I. is transmitted through line 135 to lock valve 103, and line 136 to the swashplate control piston of pump 88 to cause the pump to de-stroke and maintain a stroke just above the flow rate required to pass fluid across valve 95. Line 137 allows fluid to be dumped from the second swashplate piston of pump 88. Thus a means is provided whereby the drive pressure and thus in turn the pumped fluid pressure can be automatically maintained as selected without the creation of excessive heat and energy loss.

The hydraulic circuit defined by gage 105, orifice 106 and 107, and varible orifice 108 is a means to control the pressure that is routed to seal element 58 to cause seal 65 to operate in hydraulic oil rather than in the pumped fluid medium. Orifice 106 is a very small orifice that continually lets a small amount of pressurized fluid pass through, orifice 107 is a much smaller orifice that continually lets a small amount of fluid to pass through but at the same time causes pressure between orifice 107 and 106 to approach that of the pumping fluid pressure. Orifice 108 is a small variable orifice that can be adjusted to cause the pressure in line 139 to be adjusted as desired. Thus in practice, the pumped (mud) pressure is observed, and the seal fluid pressure (line 139) is adjusted so that the seal pressure is around 200 P.S.I. above the pumped (mud) pressure. Thus the oil will pressurize seal 65 so that seal 65 operates in oil while at the same time a minimum amount of oil will leak past seal 65. Due to the orifice arrangement the seal pressure will rise and fall with the pumped mud pressure so that the pressure differential upon seal 65 is automatically maintained within an acceptable limit. Adjustment is necessary only when the ratios between plunger (or piston) size and drive cylinder size are changed.

The significance of employing a closed loop, variable volume type hydraulic drive system instead of a conventional open loop type system is because of the improved efficiency, control features, pressure ranges, and weight and size reduction that can be attained with the closed loop system. Accumulator 109 is employed in the suction side of the system of FIG. 3 to furnish fluid for pumps 88 and 91 in case for some reason there is a momentairly lag in return flow from cylinder 11. The complete circuit is normally precharged at a low pressure by charge pump 90, with excess fluid being continually discharged across low pressure relief valve 97. It will be noted that an accumulator can be employed in high pressure line 131 as a pulsation damper means, if desired.

The entrapped fluid that is within the interconnected cylinder spaces (Chambers 51) must be continually supplied make up fluid because of leakage across seals, and also must continually be supplied with cooling fluid or it will become overheated. The interconnected system must remain at a given minimum full level at all times, depending upon the piston stroke length being employed (full stroke must be ½ full). Anything less that this minimum level will cause excessive pressure surges in the main hydraulic system because of the drive piston reaching the end of its stroke too soon. In order to satisfy the above requirements, a pump 111, a pump and motor arrangement 113, and a relief valve 101, are employed. The unit 113 consists of two pumps or a pump and a motor that are connected and driven together. The "motor" passing fluid into line 124 is of slightly larger capacity that the "pump" returning fluid to tank 104. Thus as pump 111 pumps fluid to the "motor", the fluid will be circulated through the interconnected system with a small amount being continually added to the interconnected system, with the energy requirement to accomplish this consisting only of the energy required to add the small amount of fluid added to the system. In the system illustrated in FIG. 3 where a plunger is employed to pump, then the pressure required to return the plunger is fairly constant, therefore relief valve 101 can be set just above the pressure that is required to retract the plunger and thus the excess fluid can be continually discharged across valve 101 by the drive fluid of chamber 52 or 87. Since interconnected chamber space 51 is always being continaully expanded then chamber 87 and 52 will always be in position to accept flow from the independently driven distribution valve 93. If a piston were employed on the end of plunger 231 that would require that the return force for plunger 231 to increase as the drive pressure increases, then a modified exhaust means from chambers 51 would have to be employed, such a means is illustrated in FIG. 4 and will be explained later.

It will be observed that to change liner 54 can sometimes require considerable force, also observe that plunger 231 would need to be in a position so that liner 54 is accessable. In order to accomplish the means whereby liner 54 can be easily changed, a valve 115, a valve 114, and a check valve 102 is employed. The procedure is thusly—Valve 115 is opened, which causes chambers 51 to exhaust fluid thus retracting and in turn extending plunger 231 and liner 54. A clamping means is applied to liner 54 such as a rod placed in the recess 196 and then chamber 51 is slowly expanded thus retracting housing 49 while the rod is retained from moving to cause liner 54 to be removed from housing 49. To expand chamber 51 valve 114 is closed which locks up assembly 113 so that the fluid from pump 111 is then bypassed through check valve 102 (normally spring loaded to about 75 P.S.I.) to thus expand chambers 51 and retract the plunger. It is noted that if the plunger were employed to drive a piston assembly operating within a replaceable liner, then the same procedure can be employed to remove the liner from piston, also to install the piston in the liner. Without the employment of valve 114 and 115, any attempt to position plunger 231 will incompass continual reciprocation movement of plunger 231 which is extremly difficult to contend with.

A brief description of the operation of the pumping system as illustrated in FIG. 4 is now described. The hydraulic drive system as illustrated in FIG. 4 is different in that it employes the pumping fluid to directly drive plunger 231 in each direction of travel, with the fluid within the interconnected cylinder spaces acting as a pressure equalization and timing medium. Refering to FIG. 9 note that hose connections to ports 197-A at a 90 degree spacing will always result in a direct opposite flow input and flow exhaust situation. Thus in the system of FIG. 4 expansion chamber 87 and 51 of the same cylinder are connected to valve 147 so that as one expands, the other exhausts. This is represented by flow lines 157 and 160 connected to valve 147 at 90 degree spacing. Further the directly opposed flow lines, lines 162 and 159 are connected in a like manner to a drive cylinder not affected by valve port 147 overlap (Cylinder 3). Thus valve 147 will sumultaneously apply pressure to chamber 85 of cylinder 1 and to chamber 51 of cylinder 3 to simultaneously extend the plunger of cylinder 1 and retract the plunger of cylinder 3. Chamber 52 is employed as the interconnected cylinder space section, with the intrapped fluid within chamber 52 causing the two cylinders to move in unison regardless of the loadings upon the plunger. Thus this system has a wide range of applications as a plunger drive or a piston type of push or pull characteristics. It is noted that at least four cylinders 11 must be employed in order to eliminate fluid by-pass conditions within valve 147 because at least two cylinders 11 are always being operated simultaneously.

The interconnected cylinder spaces of the circuit of FIG. 4 would normally require that the pressure within these spaces (chamber 52) be variable according to the drive fluid pressure. Thus, since fluid must be continually supplied to chambers 52, then this will require that excess fluid be continually exhausted from chamber 52 across relief valve 151. Therefore in order to eliminate a large pressure surge every time that fluid is exhausted across relief valve 151, relief valve 151 must be continually regulated to relieve at a pressure that is slightly above the required operating pressure within chamber 52 (thus creating a small and acceptable pressure surge each time flow is dumped across valve 151). To accomplish this; accumulator 152, check valve 153, flow control valve 154 and relief valve 151 are employed. Line 165 connects the inlet of accumulator 152 to the vent connection of relief valve 151. This vent line from valve 151 will receive flow from valve 151 at about 50–75 P.S.I. pressure differential between lines 164 and lines 165. Any flow from valve 151 through vent line 165 will in turn allow valve 151 to exhaust fluid from line 164. Valve 154 allows a metered flow to accumulator 152 to allow the pressure within accumulator 152 to assume the required operating pressure of chamber 52, but valve 154 will not allow the passage of a sudden large amount of fluid; Therefore the pressure within the accumulator will not suddenly change. So if chamber 52 contains excess fluid that suddenly restricts the movement of plunger 231, then this will cause a sudden rise in the pressure in line 164 which will cause fluid to be dumped (at 50 P.S.I. relative rises) across vent line 165, which in turn will allow the excess fluid to be dumped across relief valve 151. Check valve 153 allows quick restabilization of the accumulator circuit pressure. The accumulator 152 can be a simple compressible fluid oil type accumulator. The fluid can be continually exhausted from chamber 52 at a pressure slightly above the operating pressure of the fluid within chamber 52. A combination pump motor arrangement 150 continually pumps cooling fluid through interconnected chambers 52 and continually supplies a small amount of fluid to chamber 52.

It is pointed out that the cylinder 11 drive means illustrated by FIG. 4 can be employed in conjunction with the three pressure chambers (and one pumping chamber) arrangement disclosed in my now pending application Ser. No. 220,527 filed Dec. 29, 1980; Thus the circuit of FIG. 4 could be employed with the hydraulic drive cylinders of patent application number 220,527 to apply the technique of routing the hydraulic drive fluid to both sides of the drive piston to cause the hydraulic drive fluid to simultaneously drive two cylinders in opposite directions; with the third pressure chamber being employed to synchronize the two pistons movement.

It is noted that another hydraulic drive circuit arrangement that will give different operating characteristics to that of the circuit of FIG. 4 would be to connect all chambers 51 of FIG. 4 to the drive pressure line 169 (removing lines 160, 161, 162 and 163). This would cause the cylinder 11 to employ the hydraulic drive fluid to directly powerly drive the cylinders in each direction of travel but with operating characteristics simular to that of the circuit of FIG. 3, also 3 cylinders 11 could be employed in this arrangement.

It is also noted that in conjunction with the cylinder drive circuits as presented for cylinder 11, a mud piston could be attached to the end of plunger 231, the inner bore of end cap 80 constructed to slidably accept the packer element of this mud piston, the outer end of cap 80 constructed to accept either unidirectional flow valves or fitted with fluid inlets or outlets; Thus with the mud piston being either a solid type piston or a piston assembly that carries a unidirectional flow valve, then the many differing and various types of mud pumping arrangements and hydraulic drive circuit arrangements are obviously so numerous that it becomes impractical to specifically point out each and every arrangement. However of specific note, the combined unidirectional flow valve and piston arrangement that is disclosed in my now pending application Ser. No. 309,979 could be attached to the end of piston housing 49 by adding a centrally positioned rod type extension to threadingly accept the packer and valve combination; Thus with this flow through piston arrangement with cap 80 constructed to accept the piston packer and a fluid connection installed in the end of cap 80; Then with cylinder drive circuit of FIG. 4 (or of FIG. 3 modified to employ the distribution valve of FIG. 4) and the pumped fluid outlet of number 1 cylinder 11 connected to the fluid inlet of number 3 cylinder 11, and the pumped fluid outlet of number 2 cylinder 11 connected to the fluid inlet of number 4 cylinder 11—Then as cylinders (11) 1, 2, 3 and 4 are reciprocally driven, mud can be pumped through cylinders 1, 2, 3, and 4 with each cylinder 1, 2, 3, and 4 being fitted only with the one combination piston and unidirectional flow valve; Since the connected pumping cylinders will be phased at 180 degrees (direct opposite) piston stroking and so one unidirectional valve (even through moving) can function as what would normally be a stationary valve.

While a preferred embodiment of this invention has been shown by the drawings, the scope of this disclosed hydraulic cylinder drive means, or of this pumping system, is not limited to the specific applications as described; as it is intended to protect by letters patent all forms of the invention falling within the scope of the following claims:

I claim:

1. A method of pumping fluid comprising the steps of connecting the discharge lines of at least four piston pumps to a common discharge line, reciprocating the piston of each said pump in a closed chamber having inlet and outlet valves that allow fluid to be moved into position in the chamber to be pumped when the piston is moved in one direction on its suction stroke and to discharge fluid when the piston is moved in the other direction on its power stroke, said method comprising supplying first and second expansible chambers of each pump during successive overlapping time intervals with fluid under pressure to reciprocate the plungers on their power and suction strokes, and connecting third chambers of the pumps in a closed loop containing fluid that when displaced from the third chambers of pumps having the pistons on their power stroke will flow to the third chamber of one or more pumps whose piston is on its suction stroke to keep at least one piston moving on its power stroke at all times.

2. The method of claim 1 further including the step of varying the volume of fluid in the closed loop to vary the length of the stroke of the pistons.

3. A fluid pump comprising a plurality of pump housings having cylindrical bores, each housing including cylinder heads closing the cylindrical bores at each end, a tubular plunger closed at one end, seal means between the plunger and the bore of the housing at a location spaced from one cylinder head to form a fluid pumping chamber between the seal and one of the cylinder heads in which the closed end of the plunger is located to alternately draw fluid into the chamber and to force fluid out of the chamber as the plunger reciprocates, a plunger supporting member attached to the other cylinder head and extending into the bore of the housing, said support member having an opening extending longitudinally of the member through which fluid pressure can act on the plunger to move the plunger into the pumping chamber and a cylindrical outer surface concentric with and spaced from the bore of the housing to provide an annular space into which the tubular plunger extends, seal means carried by the plunger in sealing engagement with the outer surface of the support member and the bore of the cylinder to form a piston in the annular space, seal means carried by the support member in sealing engagement with the plunger and located between the piston carried by the plunger and the closed end of the plunger and means supplying fluid pressure either through the plunger support member or into the annular space on the opposite side of the piston from the seal means carried by the plunger support member to move the plunger into the pumping chamber and means supplying the annular space between the piston carried by the plunger and the seal carried by the plunger support member with fluid pressure to move the plunger out of the fluid pumping chamber.

4. The pump of claim 3 in which the plunger support member has a longitudinally extending passageway through which fluid under pressure can act on the plunger to move the plunger into the pumping chamber.

5. The pump of claim 4 in which the plunger is moved into the pumping chamber by fluid pressure acting on the piston.

6. A method of pumping fluid comprising the steps of connecting the discharge lines of at least three plunger pumps to a common discharge line, reciprocating the plungers of each pump in a closed chamber having inlet and outlet valves that allow fluid to be drawn into the chamber when the plunger is moved in one direction on is suction stroke and to discharge fluid when the plunger is moved in the other direction on its power stroke, said method comprising supplying first and second expansible chambers of each pump during successive overlapping time intervals with fluid under pressure to move the plungers on their power stroke sequentially, and connecting third expansible chambers of each pump in a closed loop containing fluid that when displaced from the third chamber of one pump when the plunger makes it power stroke will flow to the third chamber of a pump not receiving fluid under pressure in its first and second chambers and move the plunger on its suction stroke so that at least one plunger will be moving on its power stroke at all times.

7. The method of claim 6 further including the step of varying the volume of fluid supplied to the first and second expansible chambers during each power stroke to vary the length of the stroke of each plunger.

8. The method of claim 6 further including the steps of dumping fluid from the closed loop when the pressure reaches a preselected maximum to allow the volume to decrease as required to avoid interrupting the movement of the plungers and supplying make-up fluid as required to keep the closed loop full as its volume increases.

9. In a pumping system including a plurality of pumping units powered by fluid pressure comprising a plunger in each unit for pumping fluid when reciprocated, first and second expansible chambers having one movable wall connected to the plunger for moving the plunger on its power stroke when fluid under pressure is supplied to either chamber, a third chamber having one movable wall connected to the plunger for moving the plunger on its suction stroke when the third chamber is supplied with fluid under pressure, wherein the improvement comprises: means connecting at least one of the first and second chambers to a source of fluid pressure to move the plunger on its power stroke, and valve means for supplying fluid under pressure to said one of the first and second chambers of each of the pumping units in successive overlapping time intervals to move the plungers on their power strokes sequentially, and means connecting one of the other of the first and second chambers and the third chambers to the source of fluid under pressure and means connecting the chambers not connected to the source of fluid pressure to a common closed loop filled with fluid to insure that at least one plunger is always on its power stroke.

10. The system of claim 9 in which the first chamber of each pumping unit is connected to the source of fluid pressure and the third chamber of each pumping unit is connected to the closed loop.

11. The system of claim 9 in which the second chamber of each pumping unit is connected to the source of fluid pressure and the third chamber of each unit is connected to the closed loop.

12. The system of claim 9 in which the first and second chambers of each pumping unit are connected to the source of fluid pressure and the third chamber of each pumping unit is connected to the closed loop.

13. The system of claim 9 in which there are at least four pumping units and in which the first and third chambers of each unit are connected to the source of fluid pressure and the second chamber of each unit is connected to the closed loop.

14. The system of claim 9 in which there are at least four pumping units and in which the second and third chambers are connected to the source of fluid pressure and the first chamber is connected to the closed loop.

15. The system of claim 9 further provided with means for maintaining the desired volume of fluid in the closed loop.

16. The system of claim 15 in which the means for maintaining the desired volume of fluid in the closed loop includes a pressure relief valve to release fluid from the loop as required to limit the pressure in the closed loop to a preselected amount and a pump for supplying make-up fluid as required to maintain the desired volume of fluid in the loop.

* * * * *